US005982333A

United States Patent [19]

Stillinger et al.

[11] Patent Number: 5,982,333

[45] Date of Patent: Nov. 9, 1999

[54] STEERABLE ANTENNA SYSTEM

[75] Inventors: David C. Stillinger, Cardiff; Thomas J. Benacka, Carlsbad, both of Calif.

[73] Assignee: Qualcomm Incorporated, San Diego, Calif.

[21] Appl. No.: 08/922,719

[22] Filed: Aug. 3, 1997

[51] Int. Cl.[6] ..... H01Q 3/00

[52] U.S. Cl. ..... 343/766; 343/757; 343/713; 342/359

[58] Field of Search ..... 343/766, 757, 343/763, 765, 882, 713; 342/359

[56] References Cited

U.S. PATENT DOCUMENTS

| | | | |
|---|---|---|---|
| 4,295,621 | 10/1981 | Siryj | 248/183 |
| 5,173,708 | 12/1992 | Suzuki et al. | 342/359 |
| 5,453,753 | 9/1995 | Cosenza et al. | 343/765 |
| 5,619,215 | 4/1997 | Sydor | 343/766 |
| 5,764,185 | 6/1998 | Fukushima et al. | 342/359 |

FOREIGN PATENT DOCUMENTS

| | | | |
|---|---|---|---|
| 0134663 | 3/1985 | European Pat. Off. | H01Q 3/10 |
| 2173643A | 10/1986 | United Kingdom | 343/766 |
| 2266996 | 11/1993 | United Kingdom | H01Q 3/08 |

*Primary Examiner*—Don Wong
*Assistant Examiner*—Jennifer H. Malos
*Attorney, Agent, or Firm*—Russell B. Miller; Gregory D. Ogrod; Thomas M. Thibault

[57] ABSTRACT

A steerable antenna system for adjusting the elevation of an antenna for communication with a central facility via a satellite. The steerable antenna system includes a motor, a spindle drivingly engaged to the motor, and a chassis fixedly disposed on the spindle. The chassis has a stop disposed about its periphery. A first waveguide is fixedly disposed on the chassis and a second waveguide is disposed on an antenna. A ring cam is mounted on the chassis, and a grooved is formed in the ring cam. A first portion of a lever arm is pivotally mounted on the chassis and a second portion of the lever arm is disposed in the groove of the ring cam. An antenna is hingedly mounted on the chassis and to the lever arm. A solenoid, disposed on a base of the steerable antenna system, is configured to engage a portion of the ring cam. In use, when the solenoid is activated, power from the motor is used to adjust the elevation of the antenna. When the solenoid is deactivated, power from the motor is used to adjust the azimuth of the antenna to acquire a satellite.

34 Claims, 18 Drawing Sheets

STEERABLE ANTENNA SYSTEM

BACKGROUND OF THE INVENTION

I. Field of the Invention

The present invention relates to a steerable antenna system to facilitate communication between a mobile transceiver and a central station via a satellite. In particular, the present invention relates to a small aperture antenna that adjusts in azimuth and elevation to more efficiently acquire a geosynchronous satellite for communication with a central transmission facility.

II. Description of the Related Art

Mobile communication systems are utilized by commercial trucking companies to locate, identify and ascertain the status of their vehicles. Mobile communications systems are also used to send information, and receive information and information requests from the operator of the vehicles.

Such mobile communication systems often operate by sending signals from a home base or hub, also referred to as a central or fixed station, to the truck via a satellite. The truck typically has an antenna mounted on an upper surface for receiving information from the hub via the satellite. In some systems, a transceiver located in the truck operates via the antenna to send information back to the hub via the satellite.

In order for the small aperture antenna to acquire a geosynchronous satellite and maintain contact with the hub via the satellite, the antenna must be configured to adjust its position. Typically, these antennas are configured to sweep through an arc of rotation to acquire the satellite. For example, during initial acquisition, such as when the vehicle first engages the system after an off period, the antenna has no way of knowing where the satellite is located. Also, during use, when a truck turns a corner, the relative position of the antenna to the satellite changes, and the antenna must be able to maintain contact with the hub and satellite. In both cases, the antenna is configured to adjust its azimuthal position to acquire and track the satellite during movement of the vehicle.

One problem with conventional small aperture antennas is that even though they are rotatable, they are often fixed in elevational position. As the vehicle moves a substantial distance away from the orbital track of the satellite, the satellite moves lower on the horizon relative to the antenna. In this case, a conventional antenna cannot adjust its elevational position to maintain contact with the satellite. To accommodate this problem, vehicles are often equipped with antennas having a fixed high or low elevation, called a "look angle", depending on where the vehicles are generally driven in relation to the satellite's orbital track. For example, if the satellite is in geosynchronous orbit, it is generally fixed over a certain position on the earth and orbits at the same speed as the Earth's rotation along a predetermined longitude. In this example, if the satellite is in geosynchronous orbit along a longitude in the center of the United States, vehicles that are typically driven in higher latitudes, e.g., Canada, would have an antenna with a lower look angle, vehicles typically driven at or near the center of the U.S. would have an antenna with a higher look angle, and vehicles driven in lower latitudes, e.g., Mexico, would have antennas with a very high look angle. It is apparent that, in conventional, azimuth-only tracking systems, a single small aperture antenna cannot be used globally.

Another problem with conventional antennas is that to change the elevation, an additional power source may be needed. For example, a conventional gimbal system exists that concurrently adjusts azimuth and elevation of an antenna. However, this system uses a separate motor for each degree of freedom. The second motor is disposed on the antenna so that it rotates with the antenna when the azimuth is adjusted. The additional weight of this second motor requires that a large motor be used to rotate the assembly in azimuth.

What is needed is an antenna that can automatically adjust both azimuth and elevation so that it can be used on a vehicle in many different locations in the world. Further, what is needed is a cost-efficient and lightweight system to automatically adjust azimuth and elevation of an antenna. Still further, what is needed is an antenna that uses the same motor to adjust both azimuth and elevation of the antenna.

SUMMARY OF THE INVENTION

The present invention provides a steerable antenna assembly that uses a single stepper motor to control both the azimuth and elevation of an antenna. A controller causes the motor to implement a search process to rotate the antenna in search of signals from a desired signal source such as a satellite. This search process continually searches during communication to or from the source, or satellite, except during implementation of a second process for changing the elevation of the antenna. When a vehicle, or other moving or moveable object, carrying the antenna passes through a predetermined geographical region or area, the controller determines that it is desirable to raise or lower the elevation of the antenna. At this point, the controller stops the azimuth search process and implements the second process.

The second process activates a solenoid that freezes a ring cam in place. Then, the stepper motor causes the antenna to change relative position or angles to a high look angle or a low look angle, as desired. The antenna is locked in place once it reaches the appropriate look angle, so that vibration from the vehicle or supporting object will not cause a shift in elevation of the antenna. Alternatively, the antenna can be adjusted between low, mid and high look angles.

In particular, the present invention has an antenna fixedly attached to a chassis and hingedly attached to a lever arm. A motor causes the chassis and antenna to rotate. The lever arm is fixedly attached to the chassis and has pegs at one end that travel up or down ramps formed in a ring cam. Once the solenoid is activated, it freezes the ring cam in place. However, the motor causes the chassis to continue to rotate, thereby causing the pegs of the lever arm to travel up or down the ramps in the ring cam. As the lever arm travels up the ramp, the antenna rotates upwardly about hinge points to a low look angle. At the end of the ramp, a detent mechanism contacts a stop secured or formed on the chassis to hold the pegs of the lever arm in place. The motor can also cause the lever arm to travel down the ramp, so that the antenna is in a high look angle.

After the motor has stepped the lever arm through between 270°–360° so that the controller ensures that the antenna is in a correct, locked position, the controller deactivates the solenoid to allow the ring cam to rotate with the chassis a full 360°. The controller then restarts the azimuth search process to reacquire the signal source.

BRIEF DESCRIPTION OF THE DRAWINGS

The foregoing and other features and advantages of the invention will be apparent from the following, more particular description of a preferred embodiment of the invention, as illustrated in the accompanying drawings, wherein.

DETAILED DESCRIPTION OF THE PREFERRED EMBODIMENTS

A preferred embodiment of the present invention is now described with reference to the figures where like reference numbers indicate identical or functionally similar elements, and the left most digits indicate the figure number. While specific configurations and arrangements are discussed, it should be understood that this is done for illustrative purposes only. A person skilled in the relevant art will recognize that other configurations and arrangements can be used without departing from the spirit and scope of the invention.

Figure 15:
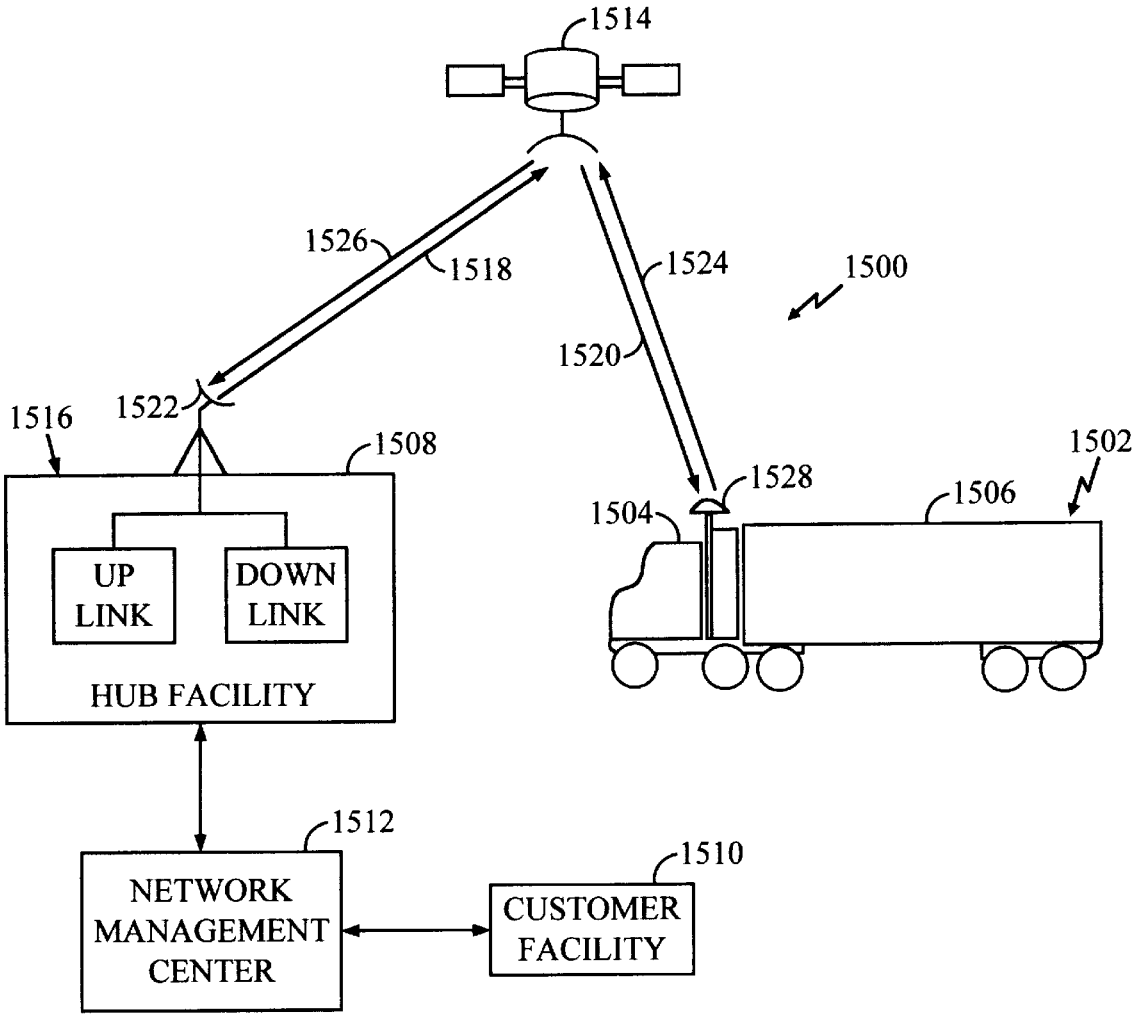
FIG. 15 shows a communication system environment in which the present invention may operate.

Referring to FIG. 15, an exemplary communication system environment in which the present invention may operate is shown. In FIG. 15, a communication system 1500 is illustrated having a known mobile communication terminal, receiver, or transceiver (not shown) mounted in a vehicle such as a truck 1502. Truck 1502 represents any of a variety of vehicles whose occupants desire to obtain occasional or updated information, status reports, or messages from a central communication source. Truck drivers or various drayage personnel often have a need for ready access to messages for more efficient operation.

It is also very desirable to have a mobile system user, such as truck 1502, to be able to communicate at least some form of limited message or acknowledgment to a central control station. Such messages may be unsolicited messages provided from the truck or messages generated in response to received messages.

A reply message may prevent the need for further communications, or indicate a need for additional information or updated messages from new information provided by the vehicle driver. At the same time, by providing for a return link of communication, even if limited in content, it is possible to incorporate other features into the communication link. Such a return link communication may be in the form of a simple message of acknowledgment to provide verification of a message received by the terminal, whether or not the driver operates on the information.

Other automatic responses may also be configured into the operation of the transceiver such as vehicle location, vehicle status, trailer identification or trailer status. The return link can also allow a driver to enter messages such as verification of time and delivery information, or a report on current position or other status information.

Truck 1502, as illustrated in FIG. 15, includes a tractor 1504 and a trailer 1506. Although truck 1502 is illustrated as having one trailer, it is understood that more or fewer trailers may be utilized. In the operation of the communications system, a message is transmitted between truck 1502 and central transmission facilities or terminal 1508, also referred to as a hub.

Hub 1508 is typically located in a location well suited for low interference ground-to-satellite transmission or reception. This location can be a remote location, however, only a clear line-of-sight to the satellite is needed. When geosynchronous satellites are used, they are typically at very high look angles to the hub. The location of the hub depends on the track of the satellite used or the orbital plane or position of the satellite, as is well known.

The present invention is described with respect to acquiring and tracking a signal of a geosynchronous satellite. However, it would be apparent to one skilled in the relevant art, that the present invention could also be used to acquire and track signals from certain lower Earth orbit (LEO) and middle Earth orbit (MEO) satellites, as long as the speed of the satellite is such that its signal can be initially acquired and reacquired after elevation scanning, by the azimuthal searching process of the present invention. Further, the present invention can be used to acquire and track signals from a local repeater or from any other signal source. The antenna can be used in acquiring a signal from a slowly moving source, or where the source remains relatively fixed, but the object supporting the antenna moves, either periodically or on miscellaneous occasions.

One or more system user facilities, i.e. customer facility 1510, in the form of central dispatch offices, message centers, or communication offices, are tied through telephonic, optical, satellite, or other dedicated communication links to hub 1508 via network management center 1512. Network management center 1512 can be employed to more efficiently control the priority, access, accounting, and transfer characteristics of message data. Network management center 1512 is typically located at the same location as hub 1508.

Network management center 1512 is interfaced to existing communication systems using well known interface equipment such as high speed modems or codecs to feed message signals into the communication system. Network management center 1512 utilizes high speed data management computers to determine message priorities, authorization, length, type, accounting details, and otherwise control access to the communication system.

Hub 1508 employs a transceiver to establish forward and return links or up and down link communication paths with a geosynchronous Earth orbiting relay or repeater satellite 1514. In one embodiment, hub 1508 uses an Extremely High Frequency (EHF) transceiver to establish these links. In another embodiment, C (approximately 6 GHz) or Ku (approximately 12 GHz) band transceivers may be used. However, other bands are also contemplated to be used in the present invention. Other than maximum physical size of the hub, frequency does not limit the technique of the present invention. These links are maintained at one or more of a number of preselected frequencies or frequency ranges. A typical satellite system employs a series of repeater transponders for transmitting 12 GHz frequency signals for TV or radio transmissions to ground stations.

Hub 1508 transmits a signal through a diplexer 1516 to an antenna 1522. In an alternate embodiment, a separate receive/transmit train could be used, depending on costs and other known design factors, as would be apparent to one skilled in the relevant art. Antenna 1522 comprises a very small aperture antenna for directing a communications signal to a single orbiting satellite.

A forward link communication signal 1518 is transmitted through antenna 1522 to communications satellite 1514 at the preselected uplink carrier frequency. Communication signal 1518 is received by repeater satellite 1514 where it may be translated to a second frequency for downlink transmission 1520. Those skilled in the art of communications understand the apparatus needed to perform this reception and conversion function which are known in the art. Using different frequencies for the uplink and downlink communication signals reduces interference.

The transmitted forward downlink signal 1520 is received by a mobile transceiver or receiver (not shown) through a small, generally directional antenna 1528. Return uplink signal 1524 and corresponding return downlink signal 1526 are passed along the same path as the forward signals via satellite 1514. Further details of the forward and return communication links are described in U.S. Pat. No. 4,979,170, entitled "Alternating Sequential Half Duplex Communication System," issued on Dec. 18, 1990, which is incorporated herein by reference.

Operating in a communication system environment such as that depicted in FIG. 15, communication may be provided from the mobile terminal in truck 1502 to customer facility 1510 to include trailer identification and load status information. Position of tractor 1504 or alternatively, position of tractor 1504 and trailer 1506 may be obtained through use of Global Positioning Satellites (GPS) to pinpoint the location of truck 1502. It will be apparent to one skilled in the art of communication the apparatus needed to implement such a GPS system. Alternately, position of tractor 1504 and trailer 1506 may be obtained through a process as described in U.S. Pat. No. 5,017,926, entitled "Dual Satellite Navigation System," issued May 21, 1991 to Ames et al., which is incorporated herein by reference. In an alternate embodiment, newer LEO communication satellite systems may be used for determining position. In this embodiment, the signal strengths and timing may be reported to hub 1508 by the transceiver, where the position of tractor 1504 and trailer 1506 are computed.

Throughout the detailed description, the invention is described as having a transceiver or receiver located in truck 1502. However, it should be understood that the transceiver may be used in association with any type of vehicle or transportable unit that would have need of an automatically adjusting antenna for acquiring different signal sources, such as but not limited to satellites, in different positions. Further, the transceiver could also be used to find other repeaters or any other source on the ground for narrow aperture systems.

Antenna 1528 is constructed to have about 15 dB of gain and to be directional within a 40°–50° elevation beamwidth and 6°–10° azimuthal or orbital beamwidth. Antenna 1528 is mounted so that it is capable of being continuously rotated through a 360° arc to have or obtain an unobstructed field-of-view of satellite 1514. Antenna 1528 is connected to an antenna pointing and tracking control system (not shown) for tracking satellite 1514 as truck 1502 changes position relative to the satellite. An exemplary antenna rotation mechanism is found in U.S. Pat. No. 4,876,554, entitled "Pillbox Antenna And Antenna Assembly," issued Oct. 24, 1989, to Duane Tubbs, which is incorporated herein by reference. Further, the antenna of the present invention is capable of being raised or lowered to adjust the look angle to better track satellite 1514.

As truck 1502 travels, antenna 1528 must be capable of maintaining contact with hub 1508 via satellite 1514. To do so, antenna 1528 is connected to a controller to enable antenna 1528 to rotate and alter its elevation to automatically acquire or track the path of satellite 1514.

Antenna 1528 is generally swept through a series of 360° arcs by a controller (not shown) until a signal is detected from satellite 1514, in the receiver's frequency range, above a predetermined threshold. At this juncture, one or more tracking and signal processes or processing methods are used to determine the direction of the highest signal strength and the antenna tracks that direction relative to the position or movement of receiver or truck 1502.

Similarly, as truck 1502 moves toward or away from the orbital plane of satellite 1514 overhead, the inclination angle for satellite 1514 with respect to antenna 1528 changes. The controller knows the orbital plane of the satellite and the location of truck 1502 relative to the satellite's orbit, so that it can determine when the elevation of antenna 1528 should be adjusted to more efficiently track satellite 1514. For example, the geosynchronous orbit or orbital track for a satellite used for communicating with a truck or other object may station the satellite at a longitude across the center of the United States. Thus, in this example, when the truck is near the southern United States border or Mexico, the satellite is stationed high overhead so that the antenna should be at a high elevation. However, as the truck moves considerably north of this longitude, the inclination angle for the satellite is lower on the horizon relative to the antenna. Thus, the antenna should be adjusted to a lower elevation.

The controller of the steerable antenna system of present invention is programmed so that when truck 1502 reaches a certain position, the controller will stop the searching process for adjusting the azimuth of antenna 1528 and will instead adjust the elevation of the antenna. After the elevational position of antenna 1528 has been adjusted, the controller causes antenna 1528 to resume a searching process to adjust the azimuthal position of antenna 1528 to reacquire satellite 1514.

In the preferred embodiment, the controller is configured to have at least one neutral band approximately 10° in latitude, in which the elevation of antenna 1528 remains unchanged. This is to prevent the controller from constantly adjusting the elevation of the antenna if the truck happens to be traveling through an area near the point at which a change in elevation becomes desirable. For example, if a truck is traveling south and crosses into the northern most portion of the neutral band, the controller will not shift the look angle until the truck passes the southernmost portion of this band.

Similarly, if the truck crosses back into the neutral band after the look angle has been changed, the controller will not instantly change the look angle back to its former position. Instead, the controller will wait to adjust the look angle until the truck passes all the way through to the other end of the neutral band. This neutral area avoids unnecessary wear and tear on the assembly and prevents constant shifting between look angles at or near the changeover point. Thus, in the preferred embodiment, the antenna will shift elevation only after it passes completely through the neutral band to the north or south of the changeover point. It would be apparent to one skilled in the relevant art that a wider or narrow band of neutral area could be used to accommodate the particular use of the antenna.

The present invention provides a steerable antenna system which uses the same motor to adjust azimuthal and elevational positions of the antenna. In an alternate embodiment, separate motors could be used to adjust azimuth and elevation simultaneously; however, such an implementation is not presented here.

Figure 16:
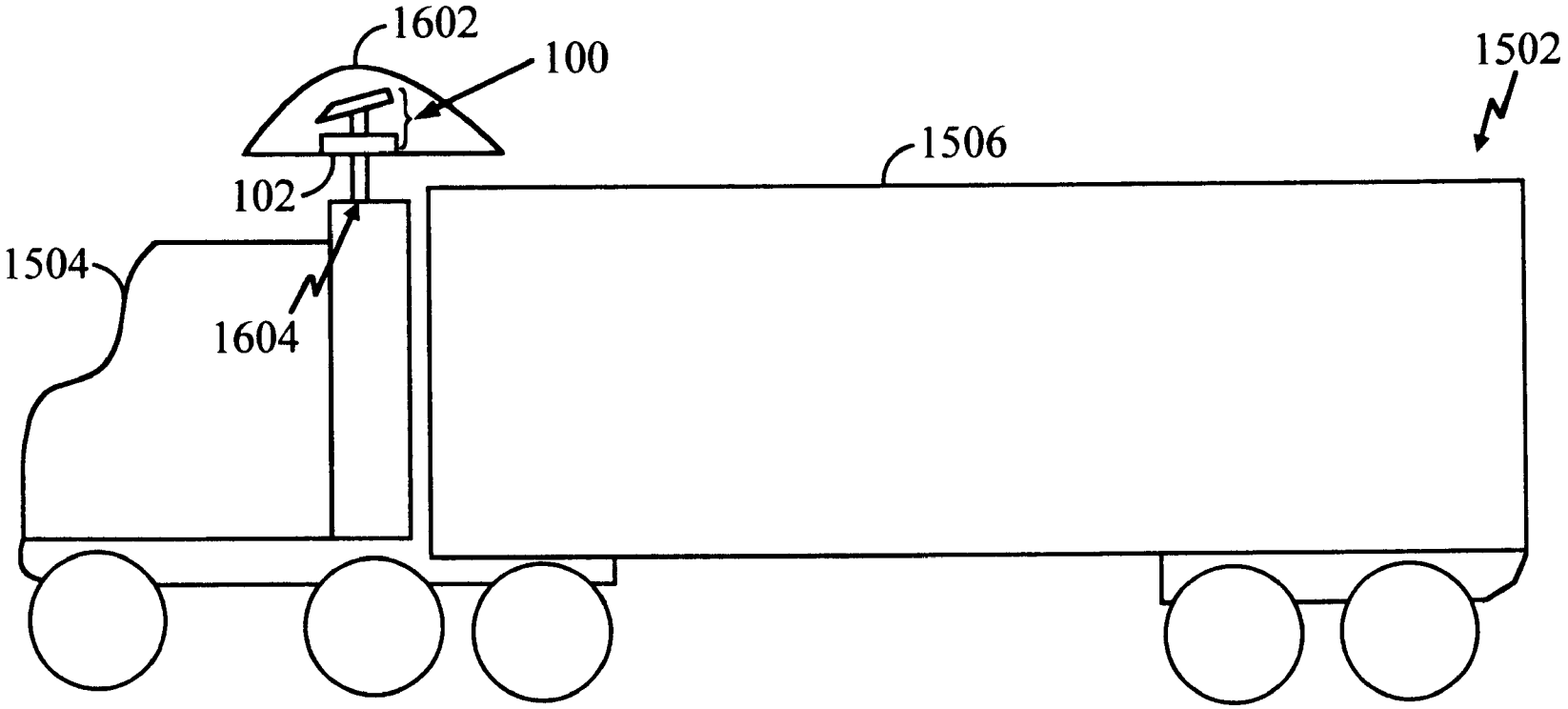
FIG. 16 shows the steerable antenna assembly of the present invention mounted on a vehicle.

With reference to the exemplary environment discussed above, steerable antenna assembly 100 is intended to be mounted on truck 1502 using a base or housing which is mounted on an upper vehicle surface, as shown in FIG. 16. In particular, in one embodiment, a base 102 of assembly 100 is mounted behind an air dam (not shown) or an upper surface 1604 of cab 1504 of truck 1502 using fasteners (not shown). Assembly 100 must be mounted at a height high enough relative to cab 1504 and trailer 1506 so that it will be able to achieve a clear line-of-sight with respect to the satellite signal. A plastic radome 1602 or other covering is mounted over the top of assembly 100 to protect it from the elements, such as, for example, exposure to rain, snow, ice and wind.

Figure 1:
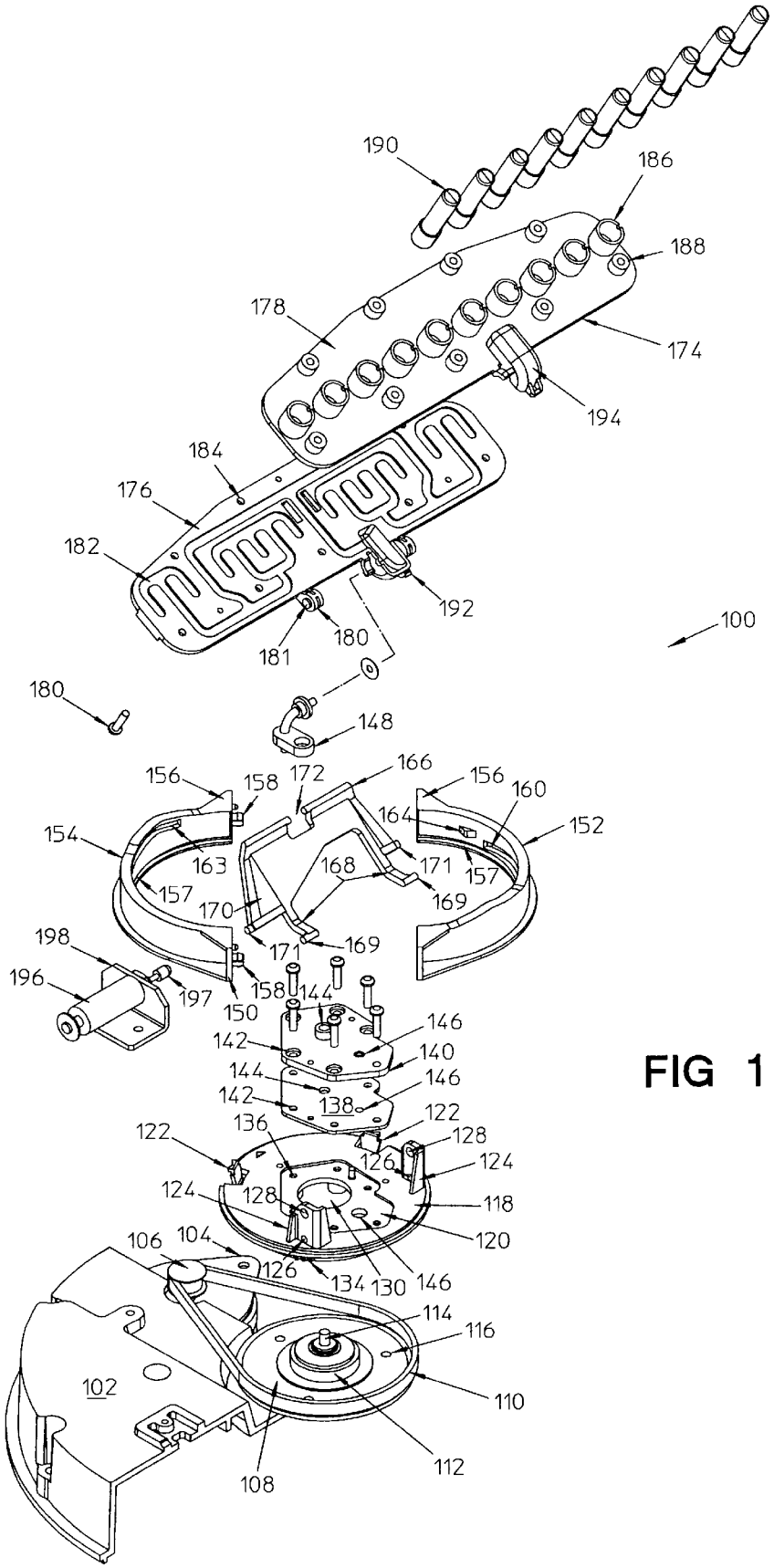
FIG. 1 shows an exploded view of a steerable antenna assembly of the present invention.

A description of the mechanics of the present invention follows with reference to FIGS. 1–14. FIG. 1 shows an exploded view of a steerable antenna assembly 100 of the present invention. Assembly 100 includes base 102, a portion of which is shown in FIG. 1. As described above, base 102 is part of the structure used to mount assembly 100 on an upper vehicle surface or other object.

Alternatively, base 102 may be disposed within an enclosure secured on the vehicle or other object. A motor 104 including a gear 106 is disposed on base 102. Motor 104 is preferably a stepper motor. In one embodiment, motor 104 operates at 200 steps per second, or roughly one revolution every four seconds. A second gear 108 is also disposed on base 102. In one embodiment, the gear ratio of second gear 108 to first gear 106 is approximately 5:1. However, it would be apparent to one skilled in the relevant art that any suitable gear ratio could be used to accommodate different motors and applications. Further, as would be apparent to one skilled in the relevant art, any one of a variety of known driving means, such as a flat belt, V-belt, gears, and like mechanisms can be used to step up motor 104.

A belt 110 is disposed around the outer perimeters of first gear 106 and around sprockets 134 molded integrally on the underside of a chassis 118 (discussed in further detail below). Chassis 118 is secured to second gear 108 so that belt 110 drivingly connects first gear 106 and second gear 108. In one embodiment, belt 110 is made from a resilient rubber material. It would be apparent to one skilled in the relevant art that any flexible material known for this type of use, could be used for belt 110. A spindle 112 including bearings (not shown) is disposed in the center of second gear 108 so that rotation of first gear 106 causes rotation of second gear 108 via belt 110 and correspondingly causes rotation of spindle 112. In one embodiment, spindle 112 is turned from aluminum. However, spindle 112 could also be made from other known materials, such as plastic, e.g., polycarbonate, ceramic, or metals other than aluminum.

A first probe 114 is fixedly disposed in the center of spindle 112. First probe 114 extends upward and into an azimuth waveguide 138 (discussed in further detail below). Thus, first probe 114 and azimuth waveguide 138 rotate about a center point of spindle 112 to provide a mechanically-free joint, i.e. a rotary joint, that provides an electrically continuous signal connection for transferring or routing of the RF signal captured by the antenna. Second gear 108 further includes holes 116 for accommodating bolts or other fasteners, such as but not limited to screws or rivets, for securing chassis 118 to second gear 108. Further, a large hole 130 is formed in chassis 118 for receiving spindle 112 and first probe 114 when chassis 118 is attached to second gear 108.

Chassis 118 includes an area 120 formed on a first side for receiving an azimuth waveguide 138. In one embodiment, chassis 118 and area 120 are formed by injection molded polycarbonate. In alternate embodiments, chassis 118 and area 120 could be formed by machining aluminum or some other relatively hard, resilient material. Azimuth waveguide 138 receives the RF signal routed from probe 114. A second probe 148 is connected to an elevation waveguide 192 and 194 to provide a mechanically-free joint, i.e., a rotary joint, that provides an electrically continuous signal connection for routing the RF signal during the elevational changes of the antenna. First probe 114 is axisymmetric, i.e., it radiates energy outwardly equally in all directions. Because first probe 114 is located in the center of spindle 112, rotation of spindle 112 will not cause a change in lateral position of first probe 114. Thus, azimuth waveguide 138 and first probe 114 can rotate with spindle 112.

A cover 140 is disposed on top of azimuth waveguide 138. Both cover 140 and azimuth waveguide 138 are formed to fit within area 120 formed on chassis 118. Holes 142 are formed in cover 140 and azimuth waveguide 138 for securing them to chassis 118. For example, cover 140 and azimuth waveguide 138 could be secured to chassis 118 using a variety of fasteners, such as, but not limited to, bolts, rivets, bonding compounds, adhesives, and welding. Further, holes or passages 144 are formed in azimuth waveguide 138 and cover 140 for receiving first probe 114. Azimuth waveguide 138 and cover 140 also have corresponding holes or passages 146 for receiving a second probe (discussed in further detail below). In one embodiment, azimuth waveguide 138 and cover 140 are made from aluminum. However, it would be apparent to one skilled in the relevant art that azimuth waveguide 138 and cover 140 could be made from any electrically conductive and relatively rigid material, including metal coated plastics.

A pair of stops 122 is formed on chassis 118 during the injection molding process. If another material is used to form chassis 118 so that the piece is not injection molded, then stops 122 could be formed independently of chassis 118 and affixed to chassis 118 by screws or other attachment mechanisms. Although the embodiment shown in FIG. 1 shows a pair of stops 122, it would be apparent to one skilled in the relevant art that the present invention could be adapted to use one or more stops. The function of stops 122 will be discussed in further detail below.

Brackets 124 are also formed on chassis 118. As discussed with respect to stops 122, if another material is used to form chassis 118, then brackets 124 could also be formed independently of chassis 118 and affixed to chassis 118 by screws or other attachment mechanisms, such as, but not limited to, bolts, rivets, bonding compounds, adhesives, and welding. Brackets 124 are used for captivating a lever arm 166 and an antenna or antenna support 174 to attach them to chassis 118. In particular, brackets 124 each have a first hole 126 and a second hole 128. First holes 126 are disposed directly across from each other on the opposing brackets and receive a first portion 168 of lever arm 166. In one embodiment, lever arm 166 is manufactured from injection molded polycarbonate. Pegs 169 are formed on first portion 168 of lever arm 166. Pegs 169 are formed to be inserted into first holes 126 of brackets 124.

Figure 3:
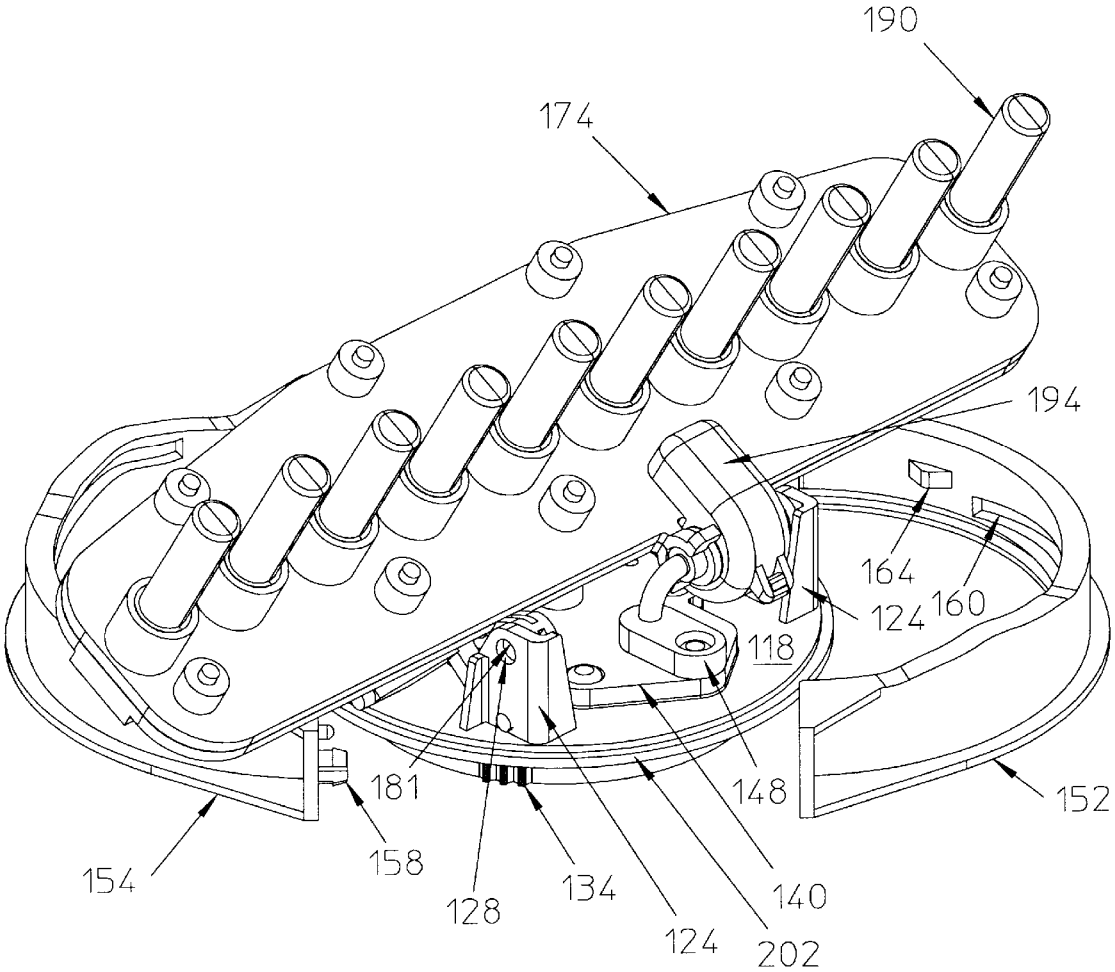
FIG. 3 shows a top, perspective view of the steerable antenna assembly of FIG. 1.
Figure 4:
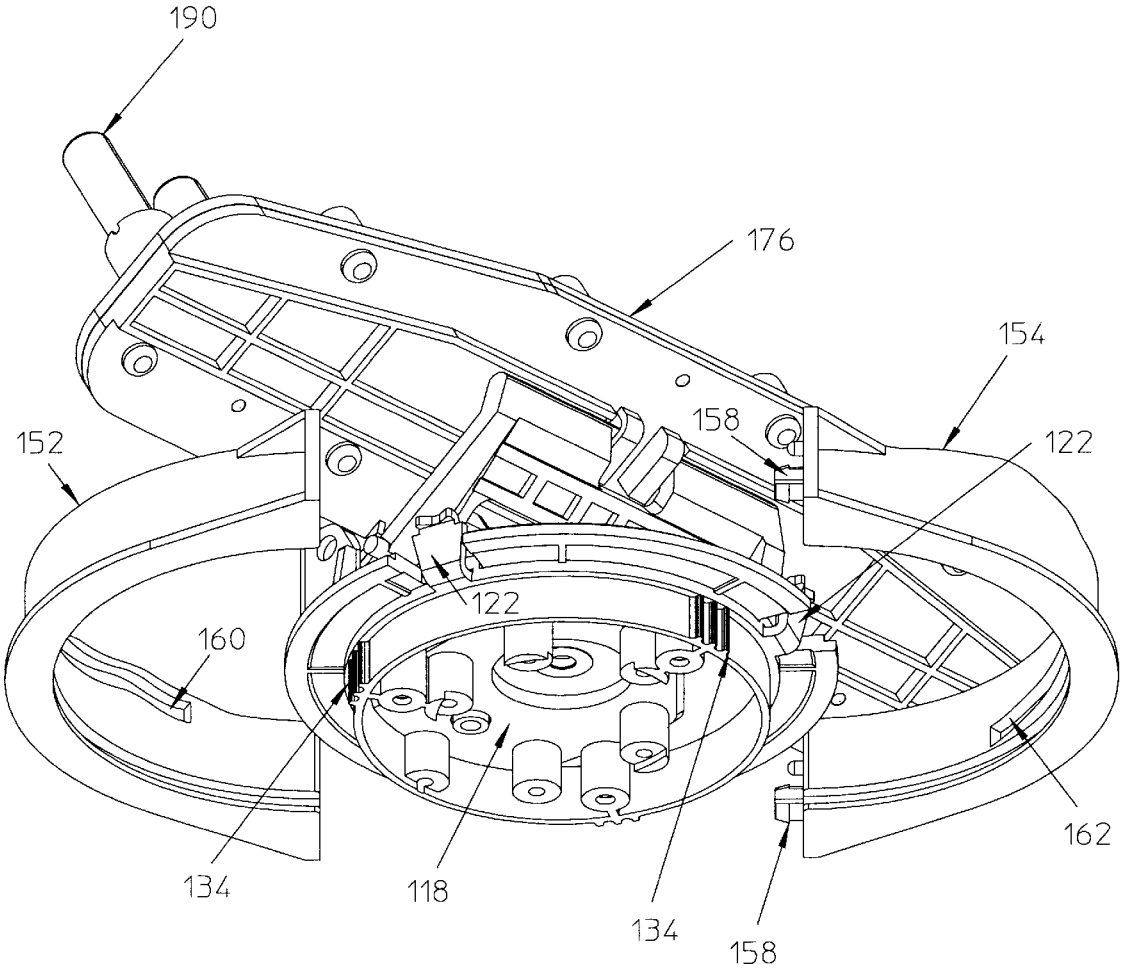
FIG. 4 shows a bottom, perspective view of the steerable antenna assembly of FIG. 1.
Figure 5:
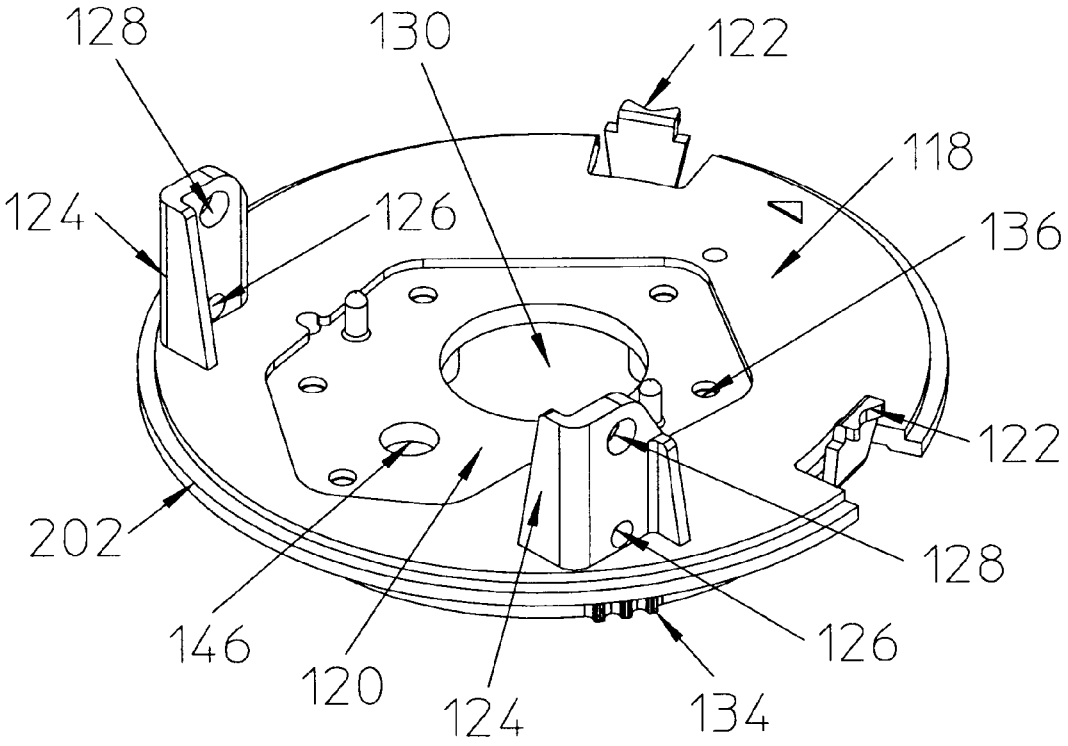
FIG. 5 shows a top, perspective view of a chassis of the steerable antenna assembly of the present invention.
Figure 6:
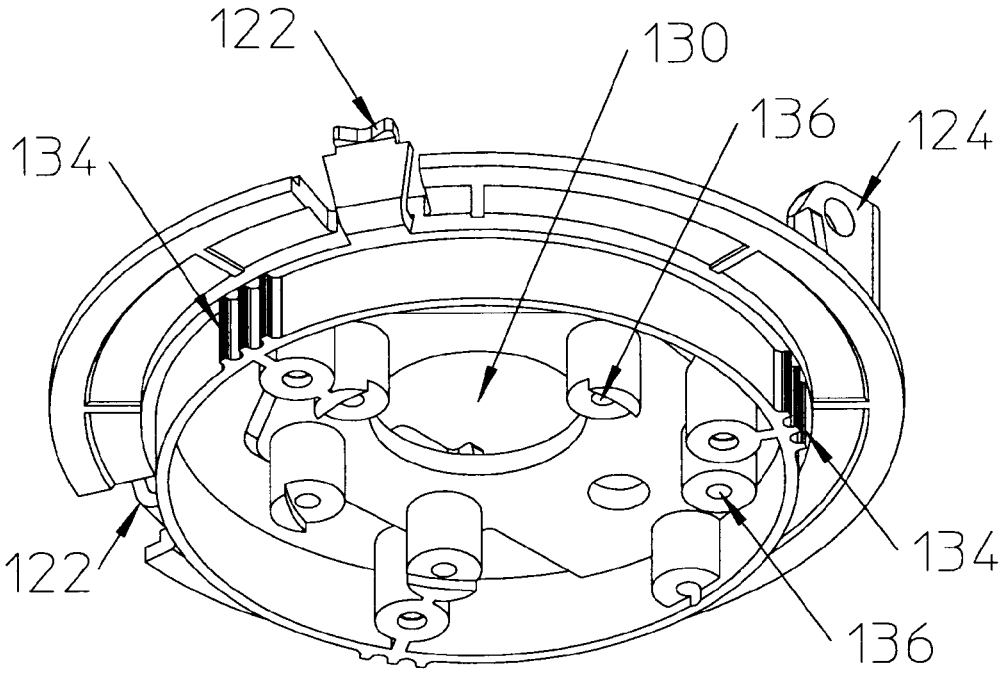
FIG. 6 shows a bottom, perspective view of the chassis shown in FIG. 5.
Figure 7:
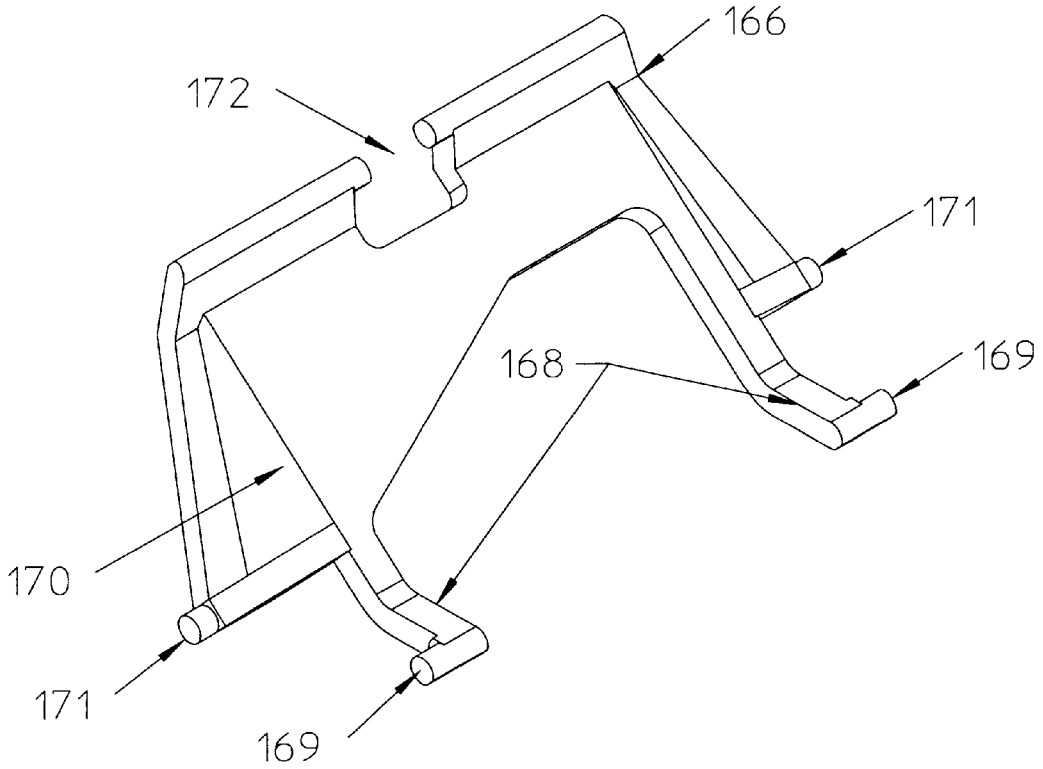
FIG. 7 shows a top, perspective view of a lever arm of the steerable antenna assembly of the present invention.
Figure 8:
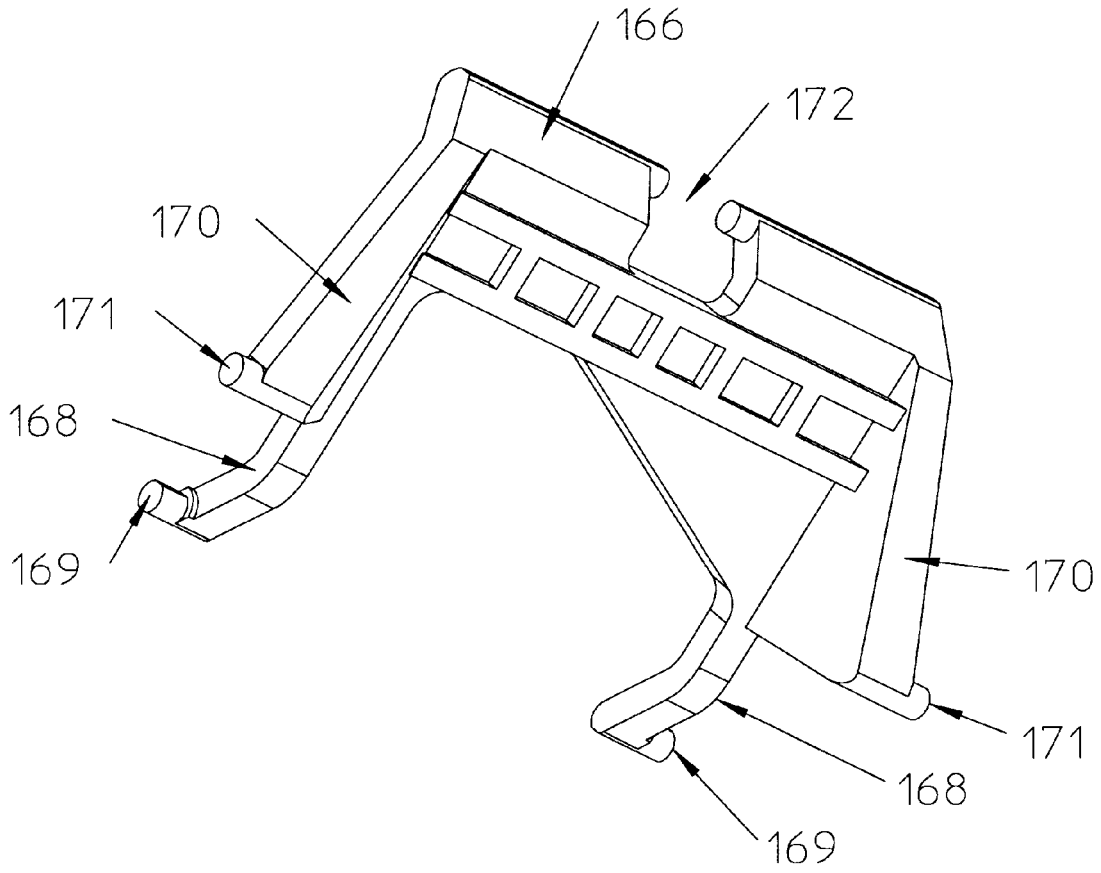
FIG. 8 shows a bottom, perspective view of the lever arm shown in FIG. 7.

Second holes 128 of brackets 124 are also disposed directly across from each other and receive a hinged portion 180 of antenna 174. In particular, a hinge pin 181 is formed in each of hinged portions 180. One end of hinge pin 181 extends beyond the outer surface of hinged portion 180. Hinge pins 181 are inserted into second holes 128 to hingedly connect antenna 174 to chassis 118 as shown in FIG. 3. It would be apparent to one skilled in the relevant art that this configuration is only one example of the manner in which antenna 174 can be hingedly connected to chassis 118. For example, in an alternate embodiment, posts having hinge pins could be mounted on chassis 118 for engaging recesses on the antenna.

Figure 2:
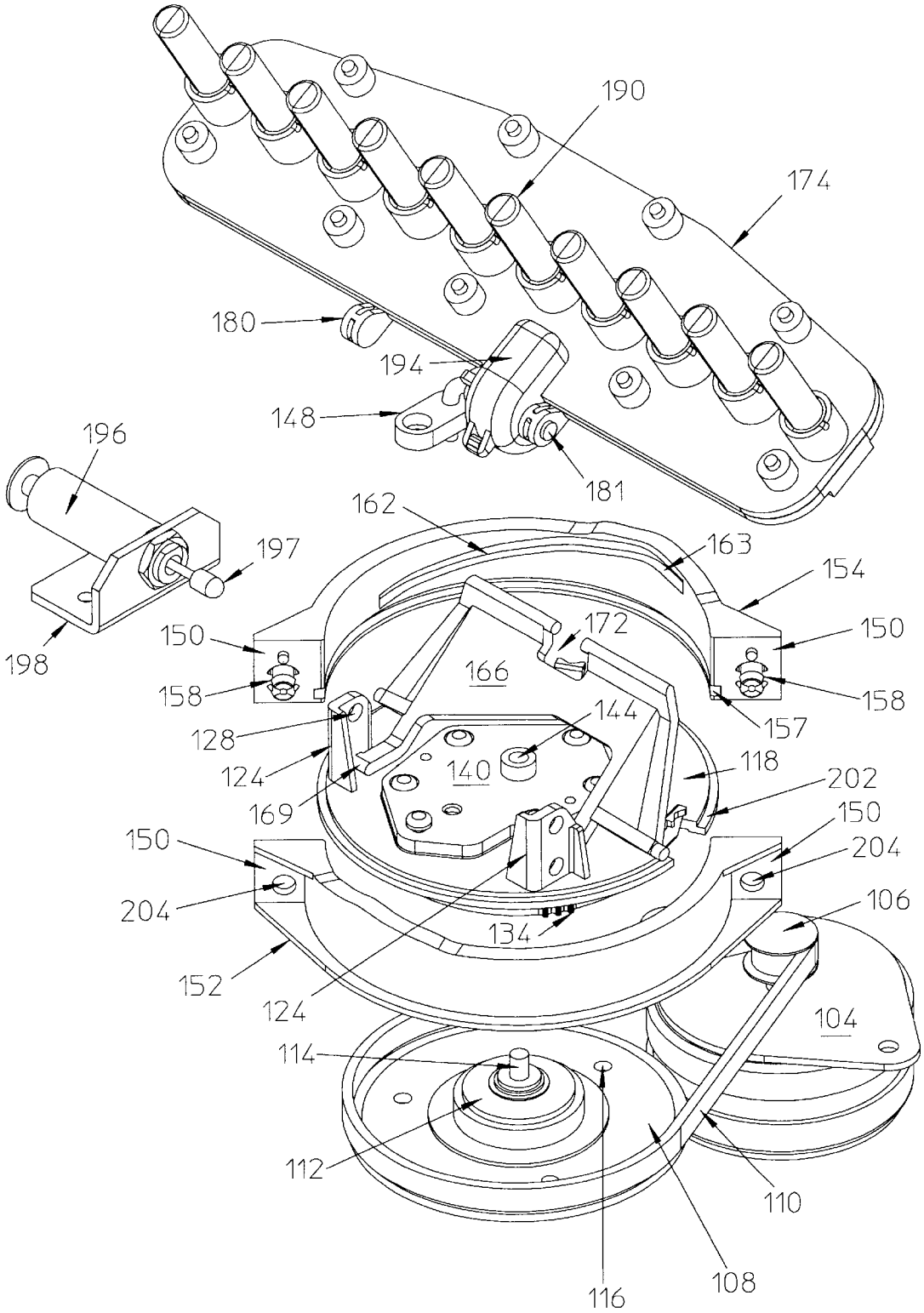
FIG. 2 shows a second exploded view of the steerable antenna assembly of FIG. 1.
Figure 9:
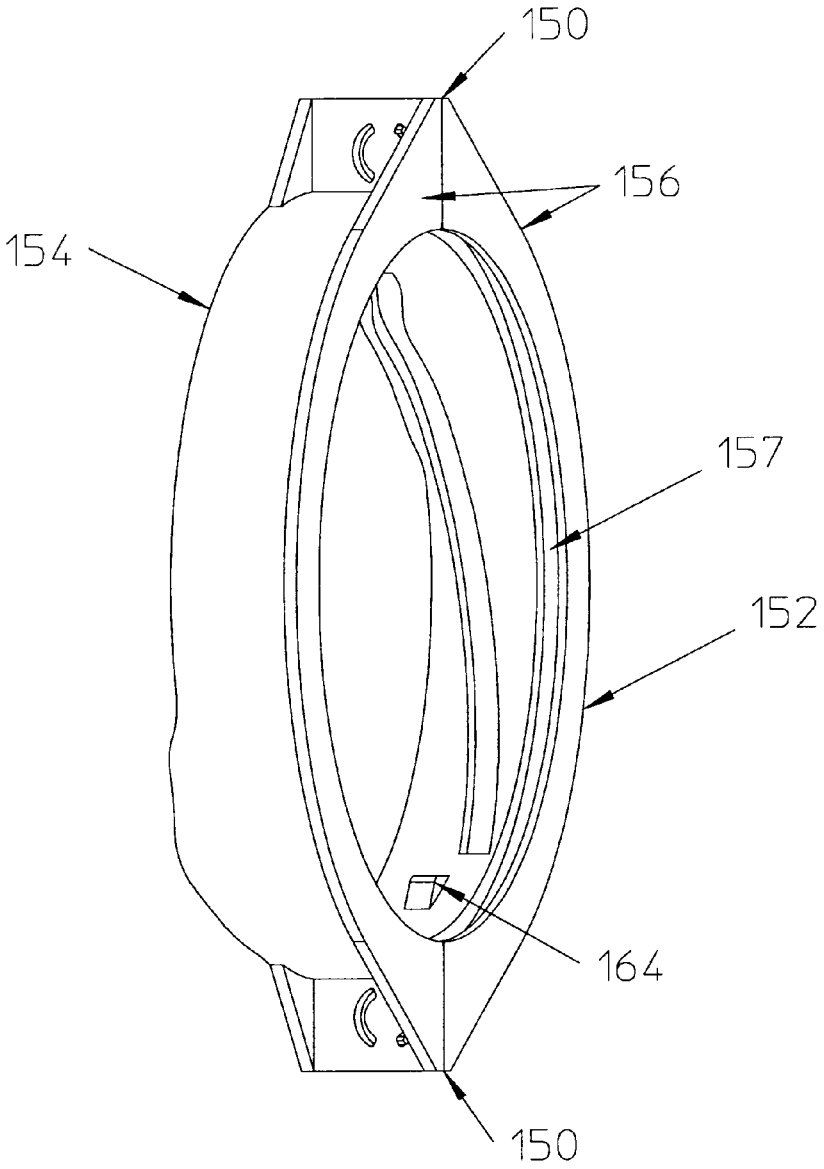
FIG. 9 shows a right, perspective view of a ring cam of the steerable antenna assembly of the present invention.
Figure 10:
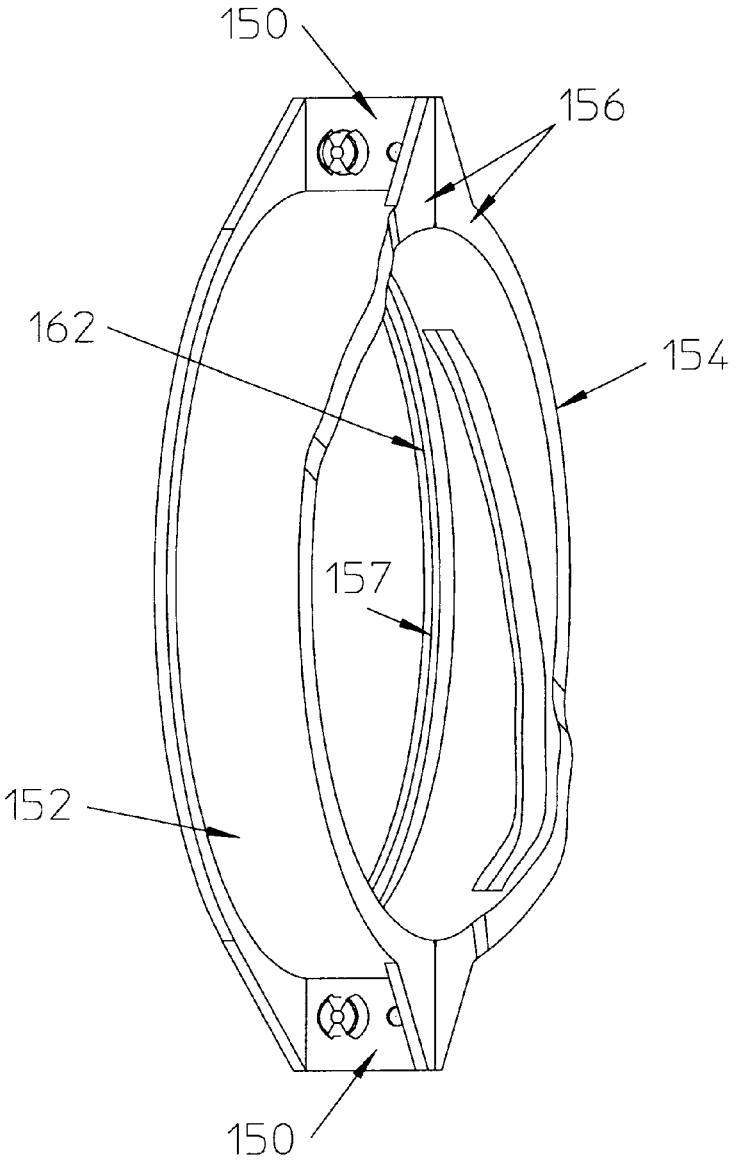
FIG. 10 shows a left, perspective view of the ring cam shown in FIG. 9.
Figure 11:
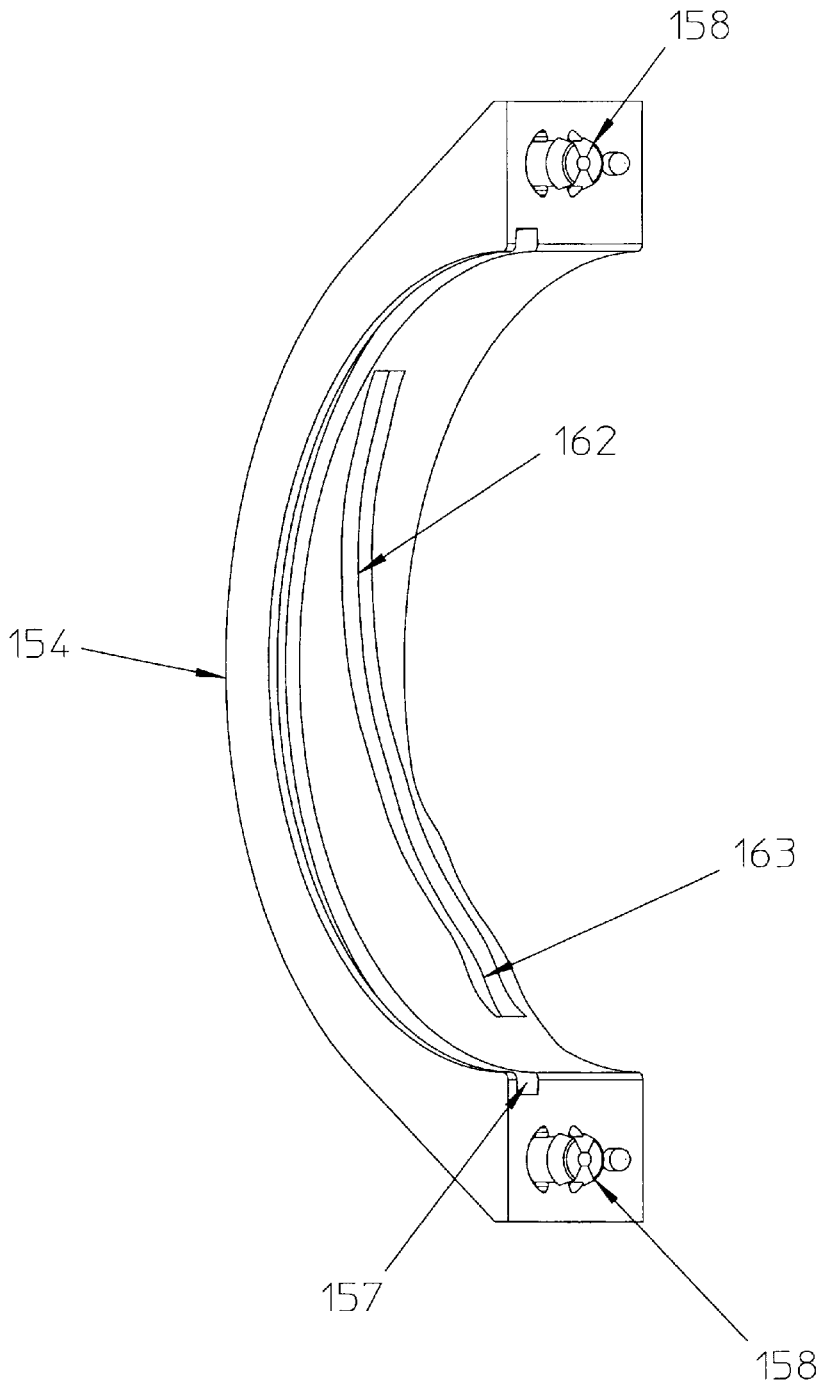
FIG. 11 shows an inner, perspective view of a first half of the ring cam shown in FIG. 9.
Figure 12:
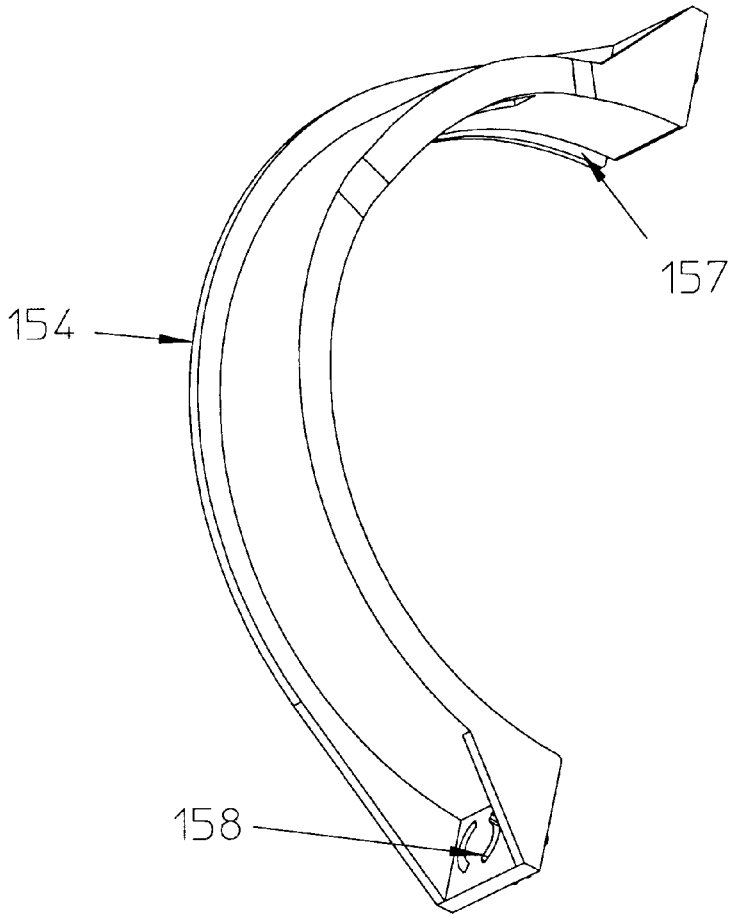
FIG. 12 shows an outer, perspective view of the first half of the ring cam shown in FIG. 9.
Figure 13:
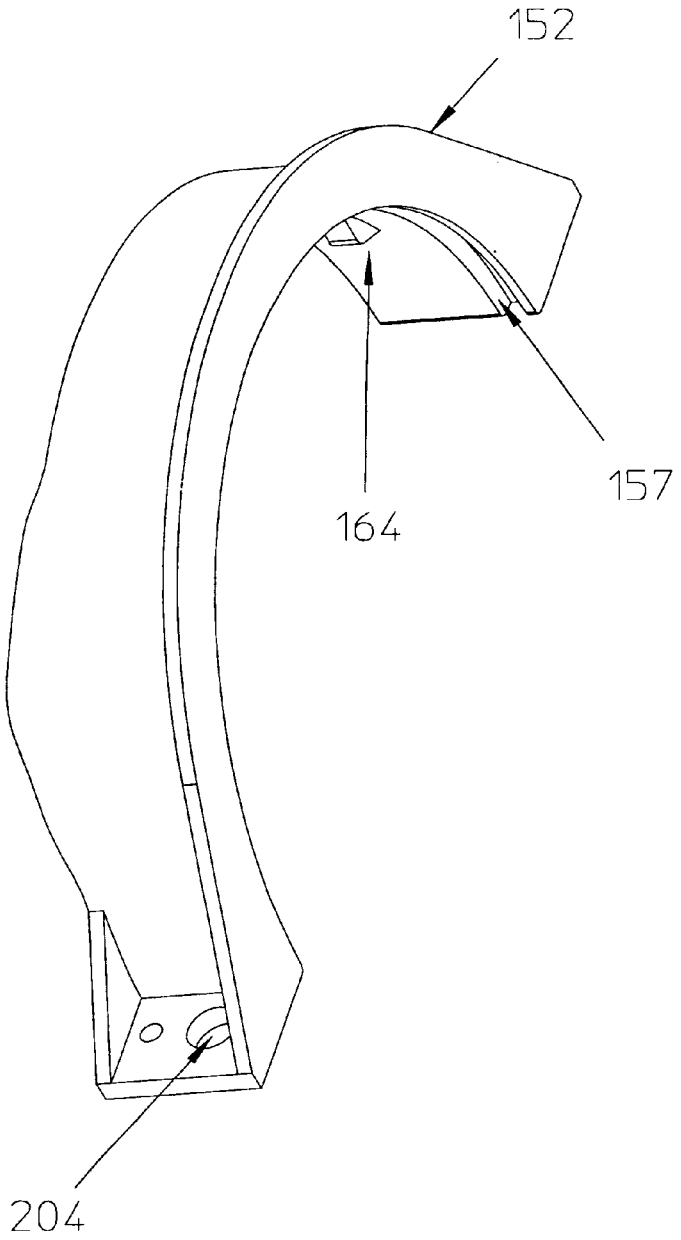
FIG. 13 shows an outer, perspective view of a second half of the ring cam shown in FIG. 9.
Figure 14:
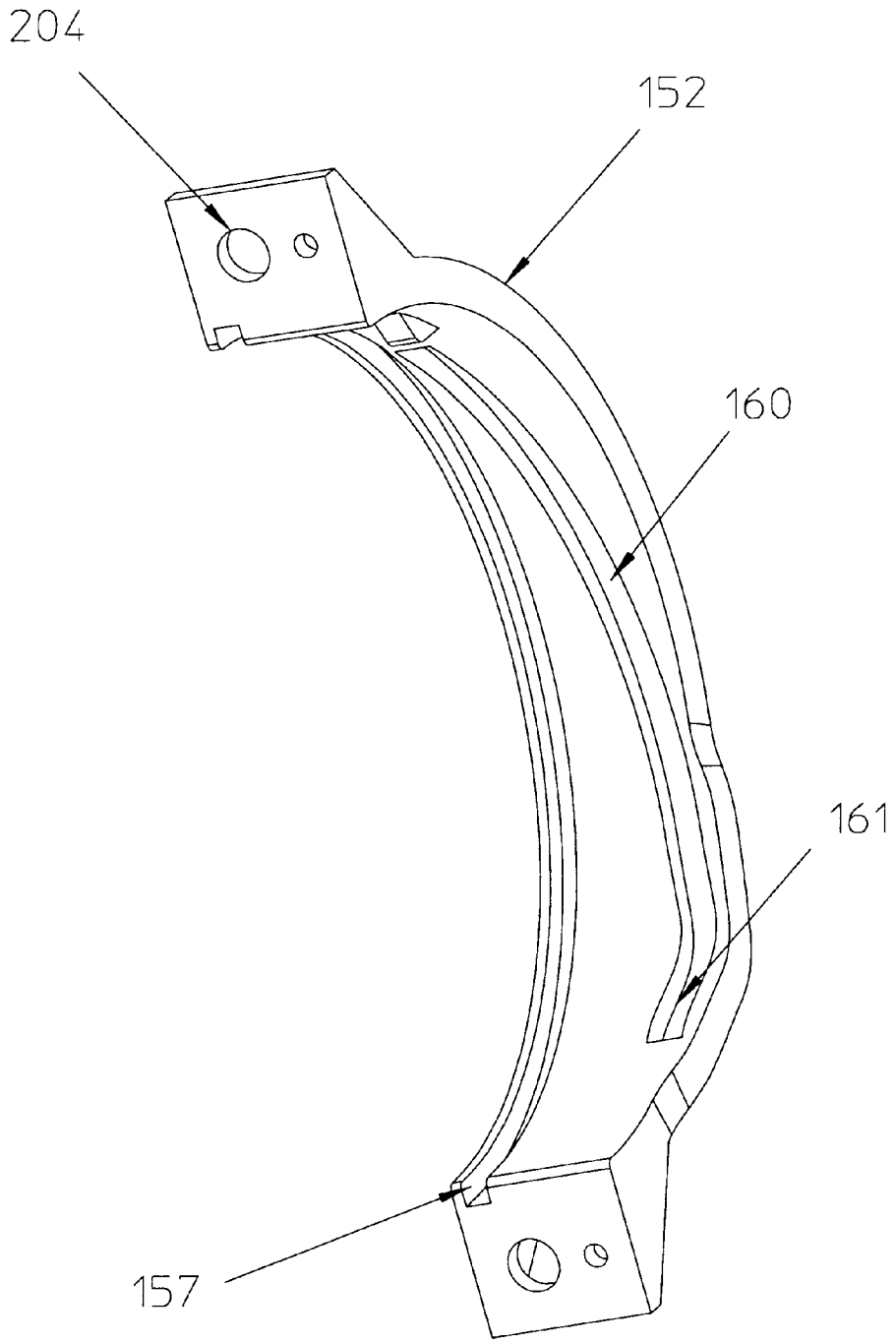
FIG. 14 shows an inner, perspective view of the second half of the ring cam shown in FIG. 9.

As shown in more detail in FIG. 2, chassis 118 has a annular protrusion or ring 202 formed around its perimeter. Alternately, chassis 118 could have a ledge, recess, depression, or offset formed around its perimeter. A ring cam 156 having a first half portion 152 and a second half portion 154 is disposed about the perimeter of chassis 118. In particular, first and second half portions 152 and 154 of ring cam 156 are each formed with a groove 157 about their respective bottom inner surfaces. To attach ring cam 156 to chassis 118, first and second half portions 152 and 154 of ring cam 156 are placed around the periphery of chassis 118 such that annular protrusion 202 fits within grooves 157. Snaps 158 projecting outwardly from second half portion 154 are snapped into holes 204 formed in first half portion 152 (as shown in FIG. 2) to captivate ring cam 156 on chassis 118. Ring cam 156 has two extending edges 150 formed at the adjacent surfaces of first and second half portions 152 and 154, as shown in FIGS. 9 and 10.

In one embodiment, first and second half portions 152 and 154 are formed from injection-molded from polycarbonate. Ring cam 156 could also be machined from a lightweight and sturdy material, such as aluminum. First and second half portions 152 and 154 of ring cam 156 are shown in further detail in FIGS. 11–14. Ring cam 156 has a first half groove 160 (partially shown in FIG. 1) on first half portion 152 and a second half groove 162 (partially shown in FIG. 1) on second half portion 154. Grooves 160 and 162 extend in the same circumferential direction around ring cam 156 and upwardly to form ramps in ring cam 156, starting on opposite interior sides of the ring cam. Second half groove 162 and first half groove 160 have substantially the same slope or pitch to prevent uneven deflection of the antenna support from one side to the next which could either misalign or change the centerline or "boresight" of the antenna during changes in look angle. The angle or pitch of these ramps relative to the central axis of ring cam 156 can be adjusted to achieve a desired height and rate of change in the elevation of the antenna, as would be apparent to one skilled in the relevant art. The design of ring cam 156 is advantageous, because it leaves the center portion open so that a rotary joint and electrical components can be disposed within the center of assembly 100. Thus, everything remains symmetrical which is important during rotation of the portions of the assembly.

As discussed above, lever arm 166 has a first portion 168 the ends of which are inserted into first holes 126 of bracket 124. Lever arm 166 also has a second portion 170 having one or more pegs 171 formed on either end. Pegs 171 are inserted into first and second half grooves 160 and 162 of ring cam 156. Thus, pegs 171 can slide up and down the ramps in ring cam 156 to adjust the elevation of lever arm 166 and thereby adjust the look angle of the antenna. A detent mechanism 164 is disposed at the end of each of first and second half grooves 160 and 162 to hold the antenna in place in either a fully elevated position, i.e., high look angle, or fully lowered position, i.e., low look angle. Detent mechanism 164 will be described in further detail below.

Second portion 170 of lever arm 166 is configured to provide angular displacement of antenna or antenna support 174 to elevate antenna 174. In the preferred embodiment, lever arm 166 provides a 30° displacement of antenna 174. In another embodiment, the angular displacement provided by lever arm 166 of antenna 174 is between 20°–50°. It would be apparent to one skilled in the relevant art that lever arm 166 could be configured to raise or lower the elevation of antenna 174 to any desired angle.

A cut-out portion 172 is formed in lever arm 166 for receiving and supporting antenna 174. Antenna 174 is shown in the figures as a helical antenna structure. However, the present invention could be used to support other antennas having different structures or forms, as would be apparent to one skilled in the art. For example, the present invention could also be used to support and adjust the position of a patch antenna or a horn antenna. Such antennas are well known to those skilled in the relevant art. Such antennas can be mounted on a platform which has a hinged portion 180 and is received in cut-out portion 172 or otherwise coupled to lever arm 166.

In this embodiment, antenna 174 is comprised of a first half housing 176 and a second half housing 178. Both first and second half housings 176 and 178 are formed from injection molded polycarbonate and are plated with a metal so that they are electrically conductive to act as a ground plane, when joined. It would be apparent to one skilled in the relevant art that first and second half housings 176 and 178 could be formed from any electrically conductive material.

Holes 184 are formed in first half housing 176 and corresponding holes 188 are formed in second half housing 178 for receiving fasteners for assembly of antenna 174. Grooves are formed in both the top surface of first half housing 176 (as shown in FIG. 1) and the bottom surface (not shown) of second half housing 178 so that when they are placed together, they form a hollow channel for receiving a printed circuit board or substrate (not shown) having a distribution feed network. The distribution feed network includes a copper trace which floats freely in the center of the channel formed by first and second half housings 176 and 178. The distribution feed network shown in FIG. 1 is shown for exemplary purposes only. Other distribution feed networks can be used in the present invention. The copper trace has a ground plane formed by first and second half housings 176 and 178 surrounding it. It has been found that this configuration allows high frequency signals traveling through the copper trace to be efficiently distributed to the antenna elements without significant loss. One end of the copper trace is connected to an elevation waveguide (discussed in further detail below).

First half housing 176 includes a lower housing 192 for an elevation waveguide. A corresponding upper housing 194 for the elevation waveguide is disposed on second half housing 178 of antenna 174. Thus, when first and second half housings 176 and 178 are joined, lower housing 192 and upper housing 194 combine to form the elevation waveguide. The elevation waveguide transfers a signal from second probe 148.

Second half housing 178 also includes bosses 186 integrally formed on the top surface. As stated above, grooves 182 are formed on the bottom surface of second half housing 178 for accommodating a printed circuit board. The printed circuit board includes a distribution feed network including the copper trace mentioned above. Helix elements (not shown) are mounted within upper radomes or covers 190. Upper radomes 190 are disposed in each of bosses 186. An additional plastic cylinder (not shown) could be disposed in the middle of bosses 186 to support and align each helix. Bosses 186 are plated so that the ground plate of second half housing 176 comes up and around the individual upper radomes 190 that are mounted within bosses 186, as disclosed in further detail in copending U.S. patent application Ser. No. 08/683,003, filed Jul. 16, 1996 entitled "Modified Helical Antenna," to Nghiem et al., which is incorporated herein by reference. Grooves 182 on first and second half housings 176 and 178 terminate at a point where each upper radome 190 is disposed on or attached to the distribution feed network of the printed circuit board. Thus, the copper trace in the printed circuit board travels to the end of each groove 182 so that each helical element within an upper radome 190 is soldered to the end of the copper trace. The copper trace also extends into the interior of the elevation waveguide and becomes a probe in that waveguide. A hole 146 is formed through cover 140 and azimuth waveguide 138 for receiving second probe 148.

Second probe 148 is a piece of coaxial cable which, in a preferred embodiment, has been jacketed with a conductive material such as copper, uses a dielectric insulation material such as polytetraflouroethylene, commerically available under the name Teflon, and includes a center conductor. As shown in FIGS. 1 and 3, a hole in second probe 148 is lined up with a hole on azimuth waveguide cover 140 so that one of the fasteners that holds down cover 140 also attaches probe 148 to azimuth waveguide 138. Second probe 148 is solidly fixed in azimuthal waveguide cover 140 and does not rotate; however, first probe 114 does rotate. Energy brought up through first probe 114 to azimuthal waveguide 138 is then turned 90° in second probe 148 and extends into the elevation waveguide of the present invention. Further, the axis on which second probe 148 enters in the elevation waveguide is in line with the axis of rotation about hinge points 180 of antenna 174. As antenna 174 rotates about hinge points 180, it is also rotating around second probe 148. Thus, the energy radiates up from the elevation waveguide into the distribution feed network of antenna 174.

Antenna assembly 100 further includes a solenoid 196. A bracket 198 mounts solenoid 196 onto base portion 102 of the assembly. Solenoid 196 further includes a plunger 197 which extends outwardly from solenoid 196 to engage a portion of ring cam 156 when actuated. In one embodiment, the actuation force of solenoid 196 is between 6–8 grams. However, the amount of vibration expected or other forces which might disengage the solenoid, as would be apparent to one skilled in the relevant art, will control the size of or force exerted by the solenoid.

Figure 17:
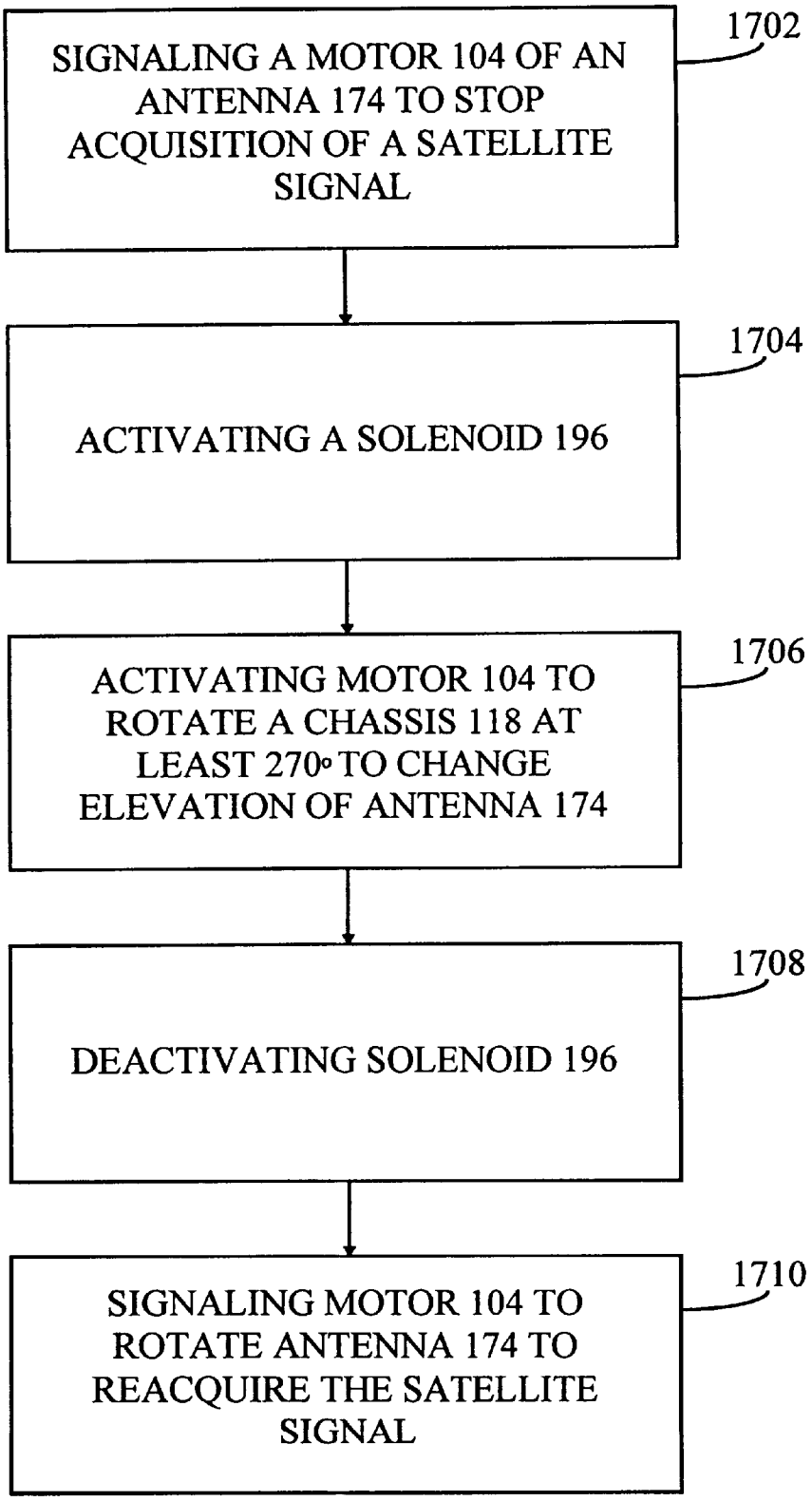
FIG. 17 shows a high level flow chart of a process of the present invention for implementing azimuth and elevation changes in the steerable antenna assembly.
Figure 18:
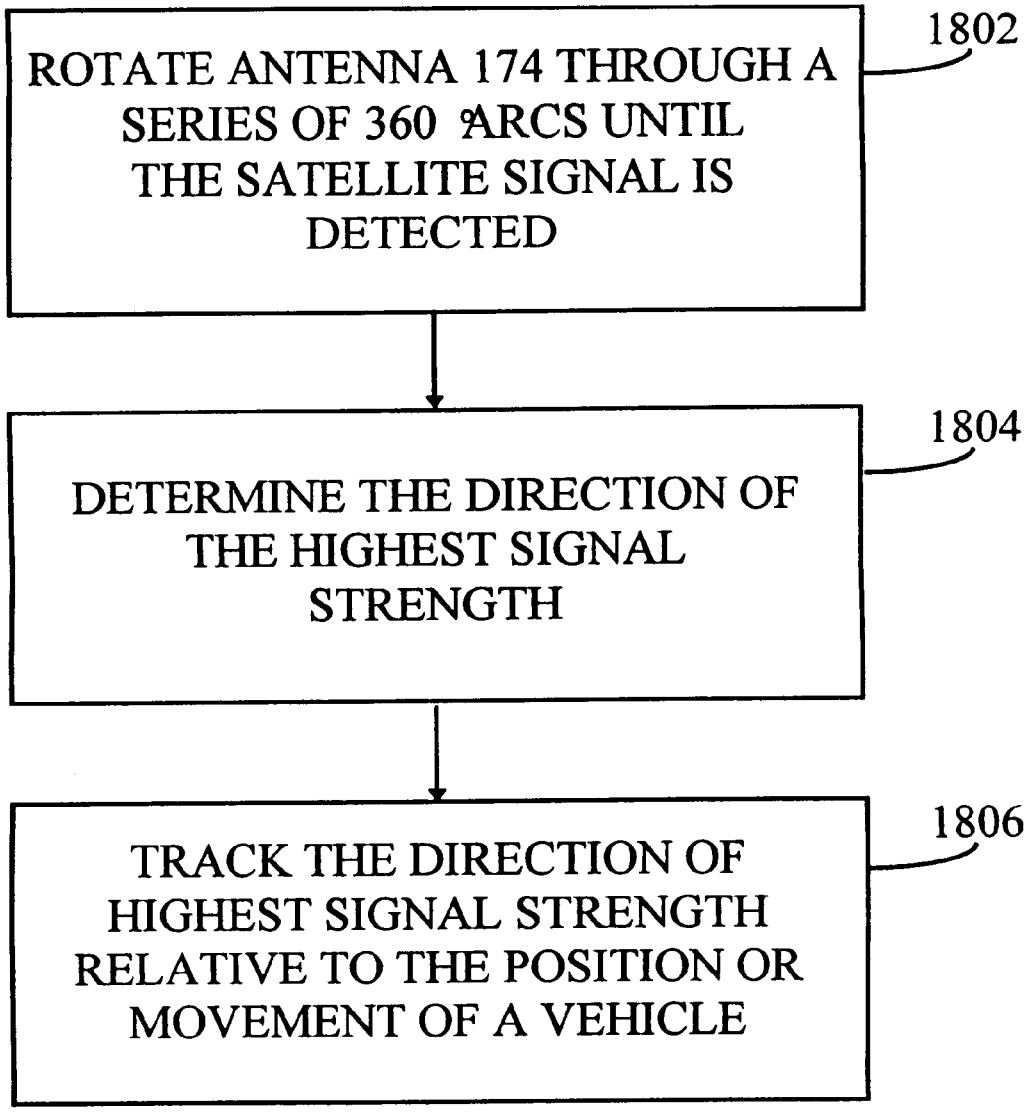
FIG. 18 shows a more detailed flow chart of the process of the present invention for implementing azimuth changes in the steerable antenna assembly.

Flow charts showing a process for adjusting azimuth and elevation of a steerable antenna assembly of the present invention are shown in FIGS. 17 and 18. In use, the controller of steerable antenna assembly 100 controls motor 104 and solenoid 196. During an azimuth searching period, the controller will use a searching process in which motor 104 rotates antenna 174 in order to acquire a satellite, as shown in FIG. 18. In particular, antenna 174 is rotated through a series of 360° arcs until a signal from a signal source, here a satellite, is detected, as shown in a step 1802. The controller then determines the direction of the highest signal strength of the received signal, as shown in a step 1804. The controller and antenna 174 then track the direction of the highest signal strength relative to the position or movement of the truck or vehicle on which assembly 100 is mounted, as shown in a step 1806. If a receiver or transceiver connected to antenna 174 loses contact with the satellite or other signal source, for example, the truck passes through a tunnel, the controller will implement the azimuth searching process, starting at step 1802, to reacquire the signal.

When the truck or other vehicle on which the assembly 100 is mounted passes through the neutral zone, the controller will determine that a change in elevation, i.e., look angle, of antenna 174 is required to efficiently receive signals from the satellite. At this point, the controller will stop the above-referenced azimuth search process, as shown in a step 1702, and will actuate solenoid 196, as shown in a step 1704. Further, the controller will use an elevation process to control the change in elevation of antenna 174, as shown in a step 1706.

In this process, activation of solenoid 196 causes plunger 197 to extend outwardly therefrom. At the same time, in the elevation process, motor 104 rotates chassis 118, and thereby rotates ring cam 156. Motor 104 rotates ring cam 156 until plunger 197 comes in contact with one of the outwardly extending edges 150 of ring cam 156 to freeze rotation of the cam. Because these edges 150 are approximately 180° apart on the perimeter of ring cam 156, the stepper motor steps the ring cam 180° to ensure that plunger 197 has come in contact with one of these extended portions. Stepper motor 104 then continues to rotate chassis 118 another 90° to raise or lower antenna 174. Plunger 197 maintains ring cam 156 in a fixed position while chassis 118 rotates within groove 157. Further, lever arm 166 rotates with chassis 118. As chassis 118 rotates within ring cam 156, pegs 171 of lever arm 166 travel up or down the ramps formed by grooves 160 and 162 on the inner portion of the ring cam. As pegs 171 travel up the ramp, antenna or antenna support 174 rotates about hinge points 180 into a low look angle. Similarly, as pegs 171 travel down the ramp, antenna 174 rotates to a high look angle. In one embodiment, lever arm 166 is configured so that pegs 171 travel vertically approximately ⅜ inches to obtain over 40° of change in elevation of antenna 174. Thus, the stepper motor causes chassis 118 to rotate at least another 90° to ensure that pegs 171 have traveled completely up or down the ramps formed by grooves 160 and 162 in ring cam 156.

Once pegs 171 have traveled completely up or down the ramp, detent mechanism 164 will come to rest within one of stops 122 on chassis 118. If the antenna happens to be less than 180° from one of the extended portions 150 of the ring cam, the motor will continue to step the full 270° to ensure that the antenna has traveled completely to its fully raised or lowered position as appropriate. Because extended piece 150 of ring cam 156 provides greater resistance to torque than motor 104 generates, once the antenna is fully raised or lowered, motor 104 will continue to electrically step, but ring cam 156 will no longer move. Detent mechanism 164 acts like a parking mechanism in step 122 so that under severe vibration antenna 174 will not be able to travel back down the ramps formed by grooves 160 and 162 of the ring cam. Thus, antenna 174 and corresponding pegs 171 of lever arm 166 will be maintained in either a fully elevated position, i.e., low look angle, or a fully lowered position, i.e., high look angle. Once lever arm 166 reaches the top or bottom of the ramp formed in the ring cam, and the motor has stepped a full 270°, the controller will deactivate solenoid 196, as shown in a step 1708, and then reactivate the azimuth searching process to reacquire the signal by adjusting the azimuthal direction using motor 104, as shown in a step 1710 and as shown in further detail in FIG. 18.

In the present invention, the controller has no way of knowing the position of antenna 174 relative to base 102. However, there is no need to monitor the elevation angle or the relative azimuthal position of satellite or antenna 174, because the stepper motor merely has to turn a sufficient number of degrees in order to know that it has rotated chassis 118 sufficiently to cause the antenna to rotate to a fully extended high or low position. In the example described above, stepper motor 104 steps chassis 118 a full 270°. In an alternate embodiment, it may be preferable for the controller to cause stepper motor 104 to rotate the chassis more than 270° in case the truck hits a bump in the road or a vibration causes the motor to skip a few steps. Thus, in an alternate embodiment, motor 104 may step between 270° to 360°.

In an alternate embodiment, antenna 174 can be rotated between three separate elevations or look angles. It is possible, for example, for grooves 160 and 162 to have slight depressions or negative slopes near a middle portion of their respective lengths to provide a mid point resting place for pins 171. However, this approach is considered less stable in the presence of vibration, and complicates control due to the natural occurrence of identical elevation positions for multiple angular displacements.

In a preferred three look angle embodiment, ring cam has two sets of grooves that run from a base position, i.e., low look angle, to different levels of elevation. For example, one of the grooves could form a first ramp that runs from the base position to a fully elevated position, i.e. low look angle, on one side of the ring cam. A second groove could run along in an opposite direction on the side of the ring cam to form a second ramp that runs from the base position to an intermediate elevated position, i.e., mid look angle.

This technique is illustrated in FIGS. 11–14, where an additional pair of grooves 161 and 163 are shown positioned adjacent and connected to the ends of grooves 160 and 162, respectively. Grooves 161 and 163 extend upwardly in an opposite circumferential direction around ring cam 156 from grooves 160 and 162. Grooves 161 and 163 form a second set of ramps in ring cam 156, starting on opposite interior sides from each other. Grooves 160 and 162 can be shorter than grooves 160 and 162 with the same pitch or slope to achieve a lower look angle with the same rate of change (slope), or can be just as long with a shallower pitch or upward angle. As before, the angle or pitch of these ramps relative to the central axis of ring cam 156 can be adjusted, as desired, to achieve a desired height and rate of change in the elevation of the antenna or antenna support for the mid look angle. Those skilled in the art will be familiar with the determination of the length and pitch of such grooves.

Pegs 171 will travel from the ends or bases of first and second half grooves 160 and 162 of ring cam 156 into grooves 161 and 163, when the chassis is rotated in the opposite direction while ring cam 156 is held stationary by solenoid 196. Thus, pegs 171 can slide up and down the ramps created by grooves 161 and 163 to place the antenna in a mid look angle position.

The antenna controller determines when a mid look angle, or movement between high and mid look angles, is desired, such as when received signal strength is higher when moving between high and low look angles and not when at those angles. The controller selects or reverses the sweep direction for the antenna (chassis) to move pegs 171 within grooves 161 and 163 (or out of grooves 160 and 162), as would be known. The amount of arc through which the chassis is rotated to select the mid look angle is determined as discussed above. Typically, a rotation of 90° (here −90° relative to high-to-low look angle rotation) is used but lesser angular displacements may be more appropriate if grooves 161 and 163 are short enough.

In one example, the stepper motor rotates the antenna so that it is in the fully elevated position and then steps the lever arm and antenna 90° down the ramp to the base position. The controller would be used to count the number of steps until the lever arm had been rotated the correct amount. The controller would then know that the antenna was positioned in the low look angle. To reach the intermediate elevated position, the motor would continue stepping the lever arm another 90° up the ramp formed in the opposite side of the ring cam. Detent mechanisms at the ends of each ramp would lock the antenna in place in the low or mid look angles. Because the high look angle is at the base position of the ramps, vibration would not likely cause the lever arm to climb up the ramps. Thus, the antenna would be locked in place in the high look angle position. It would be apparent to one skilled in the relevant art that the ring cam of the present invention could be configured to accommodate many variations in elevations of the antenna.

The previous description of the preferred embodiments is provided to enable any person skilled in the art to make or use the present invention. While the invention has been particularly shown and described with reference to preferred embodiments thereof, it will be understood by those skilled in the art that various changes in form and details may be made therein without departing from the spirit and scope of the invention.

Further, while the invention has been particularly shown and described within the context of an antenna placed on a truck, it would be apparent to those skilled in the relevant art that the present invention can be applied to manipulate the positioning of an antenna mounted on any type of moving or movable vehicle, device, or machinery. For example, the present invention could be used on a train, boat, barge, or automobile to detect position or acquire one or more signal sources continuously during use. Further, the present invention could be mounted on an airplane to detect signals or its position at discrete instances during which the airplane is at rest. The present invention could also be mounted on other objects for which one wishes to know the position or with which a communication link is desired, which could be moved or which may change position during use.

What we claim as our invention is:

1. A steerable antenna system, comprising:

a motor;

a spindle drivingly engaged to said motor;

a chassis fixedly disposed on said spindle, said chassis having a stop disposed about a periphery thereof;

a ring cam, disposed on said chassis and having at least one groove formed therein;

a lever arm, wherein a first portion of said lever arm is disposed in said groove of said ring cam and a second portion of said lever arm is pivotally mounted on said chassis;

an antenna hingedly mounted on said lever arm; and a solenoid disposed on a base portion of said steerable antenna system and configured to engage a portion of said ring cam, wherein, when said solenoid is activated, said motor adjusts the elevation of said antenna, and wherein, when said solenoid is deactivated, said motor adjusts the azimuth of said antenna to acquire a signal from a desired signal source.

2. The steerable antenna system of claim 1, wherein said desired signal source comprises a moving source.

3. The steerable antenna system of claim 2, wherein said moving source comprises a satellite.

4. The steerable antenna system of claim 1, wherein said desired signal source comprises a terrestrial repeater.

5. The steerable antenna system of claim 1, wherein said motor comprises a stepper motor.

6. The steerable antenna system of claim 1, further comprising:

a belt drivingly engaging said spindle and said motor; and at least one sprocket disposed about a periphery of said chassis for frictionally engaging a portion of said belt.

7. The steerable antenna system of claim 1, wherein said ring cam has a first half portion and a second half portion.

8. The steerable antenna system of claim 1, wherein said ring cam has a detent formed at either end of said groove.

9. The steerable antenna system of claim 1, wherein said lever arm has a displacement angle less than or equal to 40 degrees.

10. The steerable antenna system of claim 1, wherein said antenna comprises:

a first half housing;

a second half housing having a plurality of bosses integrally mounted on one side of said second half housing;

a printed circuit board having a distribution feed network formed thereon, disposed between said first half housing and said second half housing; and a helix disposed in each of said plurality of bosses on said second half housing.

11. The steerable antenna system of claim 1, wherein said motor has a rotating shaft, and wherein said spindle is drivingly engaged to said rotating shaft.

12. The steerable antenna system of claim 1, further comprising:

a waveguide disposed on said chassis; and a first probe fixedly disposed in the center of said spindle and extending upwardly through a hole formed in said waveguide.

13. The steerable antenna system of claim 12, further comprising a second probe fixedly disposed in a set of corresponding holes formed in said waveguide and said chassis and extending into a second waveguide affixed to said antenna.

14. The steerable antenna system of claim 1, wherein said chassis has two stops disposed about a periphery thereof.

15. The steerable antenna system of claim 1, wherein said antenna is alternately adjustable to first and second elevations.

16. The steerable antenna system of claim 1, wherein said antenna is alternately adjustable to first, second and third elevations.

17. The steerable antenna system of claim 1, wherein an antenna feed of said antenna comprises metal plated polycarbonate.

18. A steerable antenna system, comprising:

a motor;

a spindle drivingly engaged to said motor;

a chassis fixedly disposed on said spindle;

a cam, disposed on said chassis and having at least one groove formed therein;

a lever arm, wherein a first portion of said lever arm is disposed in said groove of said cam and a second portion of said lever arm is pivotally mounted on said chassis;

an antenna hingedly mounted on said lever arm; and a solenoid disposed on a base portion of said steerable antenna system and configured to engage said cam, wherein, when said solenoid is activated, said motor adjusts the elevation of said antenna, and wherein, when said solenoid is deactivated, said motor adjusts the azimuth of said antenna to acquire a signal from a desired signal source.

19. The steerable antenna system of claim 18, wherein said desired signal source is a moving source.

20. The steerable antenna system of claim 19, wherein said moving signal source is a satellite.

21. The steerable antenna system of claim 18, wherein said desired signal source is a terrestrial repeater.

22. The steerable antenna system of claim 18, wherein said chassis has a stop disposed about a periphery thereof.

23. The steerable antenna system of claim 18, further comprising a first waveguide fixedly disposed on said chassis.

24. The steerable antenna system of claim 23, further comprising a second waveguide disposed on said antenna.

25. The steerable antenna system of claim 18, wherein said cam is a ring cam.

26. A steerable antenna system, comprising:

a chassis rotatingly connected to a motor;

a cam disposed on said chassis, said cam having at least one groove formed therein;

a lever arm having a first portion mounted in said groove of said cam and a second portion pivotally mounted on said chassis, and wherein said lever arm is configured to support an antenna; and a solenoid, disposed on said steerable antenna system, wherein rotation of said chassis while said solenoid is activated causes an adjustment in elevation of said antenna and wherein rotation of said chassis while said solenoid is deactivated causes an adjustment in azimuth of said antenna.

27. A method for adjusting an antenna, comprising the steps of:

(a) signaling a motor of said antenna to stop acquisition of a signal from a desired signal source;

(b) activating a solenoid;

(c) activating said motor to rotate a chassis of an assembly between 270° and 360° so that rotation of said chassis is translated into adjustment of the elevation of said antenna;

(d) deactivating said solenoid; and (e) using said motor to rotate said antenna so that said desired source signal can be reacquired.

28. The method of claim 27, wherein reacquiring said desired signal source comprises the step of acquiring a moving source.

29. The method of claim 28, wherein the step of acquiring a moving source comprises the step of acquiring a satellite.

30. The method of claim 27, wherein reacquiring said desired signal source comprises the step of acquiring a terrestrial repeater.

31. The method of claim 27, wherein actuation of said solenoid occurs automatically when said antenna passes through a predetermined latitude.

32. The method of claim 27, wherein said antenna can be adjusted between a first elevation and a second elevation.

33. The method of claim 27, wherein said antenna can be adjusted between a first elevation, a second elevation, and a third elevation.

34. The method of claim 27, wherein said step (e) further comprises:

(i) rotating said antenna in a series of 360° arcs until said signal is detected;

(ii) determining a direction of a highest signal strength of said signal; and (iii) tracking said direction of highest signal strength relative to a position or movement of a vehicle on which said antenna is mounted.

* * * * *